US005097867A

United States Patent [19]

Frigiere et al.

[11] Patent Number: 5,097,867

[45] Date of Patent: Mar. 24, 1992

[54] RESERVOIR FOR COMBUSTIBLE LIQUID USED AS GAS

[75] Inventors: Rene Frigiere, Charbonnieres les Bains; Philippe Grel, Lyons, both of France

[73] Assignee: Cricket, Rillieux La Pape, France

[21] Appl. No.: 668,942

[22] Filed: Mar. 13, 1991

[30] Foreign Application Priority Data

Mar. 15, 1990 [FR] France ..... 90 03849

[51] Int. Cl.[5] ..... F23D 14/28

[52] U.S. Cl. ..... 137/590; 431/344

[58] Field of Search ..... 137/590; 431/131, 276, 431/277, 344

[56] References Cited

U.S. PATENT DOCUMENTS

| | | | |
|---|---|---|---|
| 3,291,184 | 12/1966 | Varvel | 137/590 X |
| 3,510,102 | 5/1970 | Sungaila | 137/590 X |
| 3,523,005 | 8/1970 | Piffath et al. | 431/344 |
| 3,542,499 | 11/1970 | Karran | 431/344 |
| 3,955,913 | 5/1976 | Benzaria | 431/344 |
| 4,060,202 | 11/1977 | Neyret | 431/344 X |
| 4,201,537 | 5/1980 | Nitta | 431/344 |

*Primary Examiner*—John Rivell

*Attorney, Agent, or Firm*—Herbert Dubno; Andrew Wilford

[57] ABSTRACT

A reservoir for a gaseous combustible stored as a liquid has a substantially closed container having a side wall, an upper wall, and a bottom wall, the upper wall is formed with an outlet port. A porous mass generally fills the container and is saturated with a body of the combustible in liquid condition. A dip tube has an upper end joined to the upper wall at the outlet and a lower end formed with at least one orifice of such small size that a meniscus/interface is formed between the liquid and gaseous phases at the orifice. The tube is formed with a crosswise web at its lower end and the orifice is above this web on a side of the tube. Furthermore the container is generally cylindrical and centered on an axis, the outlet and tube is coaxial with the container.

9 Claims, 1 Drawing Sheet

RESERVOIR FOR COMBUSTIBLE LIQUID USED AS GAS

FIELD OF THE INVENTION

The present invention relates to a reservoir for a combustible liquid used as a gas. More particularly this invention concerns a disposable reservoir used in a gas lighter.

BACKGROUND OF THE INVENTION

A gas lighter, gas candle, hair curler, iron, soldering gun, lamp, or the like can be provided with a gas supply constituted as a reservoir bottle that is filled with the combustible gas in liquid form. The reservoir can be a permanent part of the piece of equipment or can be disposable.

So long as it is in liquid condition, a normally gaseous combustible is a body comprises of a single component or blend of components that are liquid at the pressure and temperature at which it is normally stored, the liquid phase being in thermodynamic equilibrium with its gaseous phase. Once this equilibrium has been attained, the interface between the two phases is planar when they alone occupy the reservoir. This interface has a radius of curvature when the liquid phase is held in a porous body, for instance made of a block of felted fibers. In this case the viscosity and the surface tension of the liquid phase allow a modification of the liquid/-vapor equilibrium and retention of the liquid phase in the middle of the porous body.

The gas can also be dissolved in a thickening or gelling solvent such as in particular polymers of low molecular weight such as methacrylates, fatty acids like sodium palmitate, colloidal silicates, carboxyl acid salts of aluminum, and the like.

The reservoir is normally provided with a valve for controlling the outflow of the combustible, typically with a pressure-reducing filter. This outflow controller is set up to work with the liquid or the gaseous phase as it is virtually impossible to design such a controller that can operate with both phases or with the phases mixed. Since the gaseous phase is always above the liquid phase, the reservoir is typically provided with an outlet on its upper wall and the outflow controller is set to work with the gaseous phase only.

When the reservoir is, as is typical, of cylindrical shaped with upper and lower walls perpendicular to the axis of the cylinder, the outlet is centrally formed in the top wall. A cylindrical porous block is used to hold a large quantity of the combustible. The problem with this standard construction is that when the reservoir is overfilled, as is possible in a fast mass-production operation, the excess liquid is not all trapped in the porous body so that the liquid itself can get into the outlet. This blocks it and makes the system nonoperational.

OBJECTS OF THE INVENTION

It is therefore an object of the present invention to provide an improved reservoir for a combustible liquid used as a gas.

Another object is the provision of such an improved reservoir for a combustible liquid used as a gas which overcomes the above-given disadvantages, that is which ensures that even if the reservoir is overfilled the outflow controller will remain operational.

SUMMARY OF THE INVENTION

A reservoir for a gaseous combustible stored as a liquid has a substantially closed container having a side wall, an upper wall, and a bottom wall, the upper wall is formed with an outlet port. A porous mass generally fills the container and is saturated with a body of the combustible in liquid condition. According to the invention a dip tube has an upper end joined to the upper wall at the outlet and a lower end formed with at least one orifice of such small size that a meniscus interface is formed between the liquid and gaseous phases at the orifice. The tube is formed with a crosswise web at its lower end and the orifice is above this web on a side of the tube. Furthermore the container is generally cylindrical and centered on an axis, the outlet and tube is coaxial with the container.

Thus a meniscus will form at the orifice and the gas will vaporize and rise from this meniscus in the tube. It will be impossible for liquid to rise in the tube, but gas flow will be sufficient to support combustion.

According to another feature of the invention the orifice is an elongated throughgoing slot. In addition it is formed with a plurality of such orifices angularly equispaced about the axis, normally three such orifices.

Furthermore according to the invention the tube has an upper end provided with an outflow controller and this tube is unitarily formed with the top wall.

For best results the container has a predetermined height and the tube has a predetermined vertical length equal generally to half of the height.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
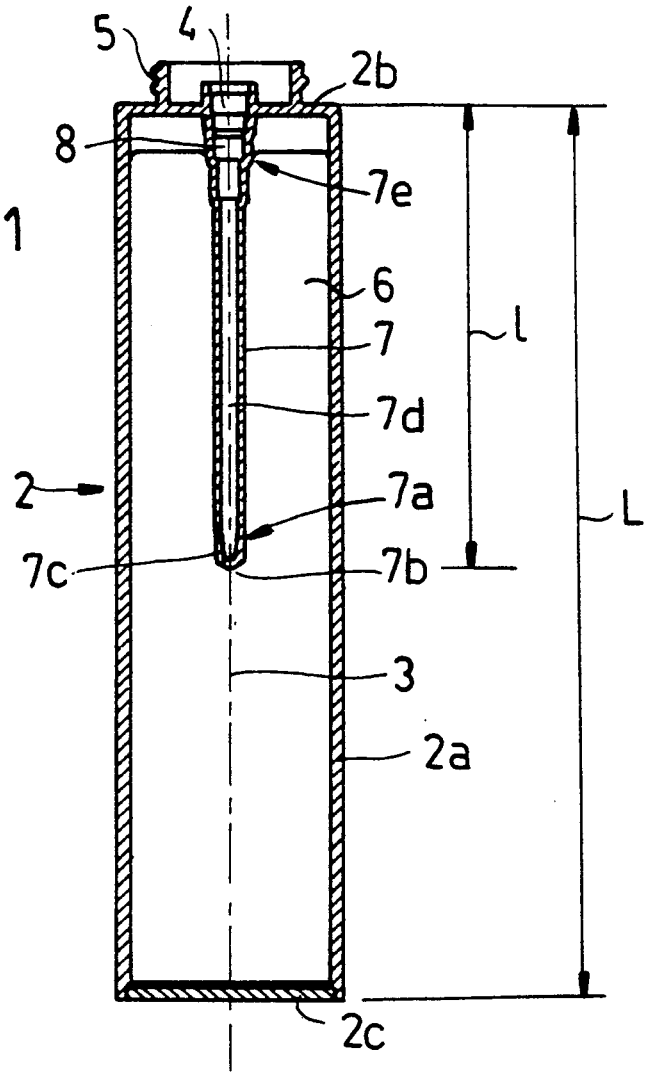
FIG. 1 is an axial section through the reservoir according to this invention.

As seen in FIG. 1 a reservoir 2 according to the invention has a cylindrical side wall 2*a* centered on a normally upright axis 3, a planar top wall 2*b* perpendicular to the axis 3, and a planar bottom wall 2*c* also perpendicular to the axis 3. The top wall 2*b* is formed centered on the axis 3 with an outlet port 4 and is provided with a threaded neck 5 coaxial with this outlet 3 to allow the reservoir 2 to be screwed into a piece of equipment. The reservoir 2 holds a porous body 6 formed as a cylindrical block of fibers slightly shorter than the internal height L of the reservoir 2 and this body 6 is saturated with a combustible liquid.

Figure 2:
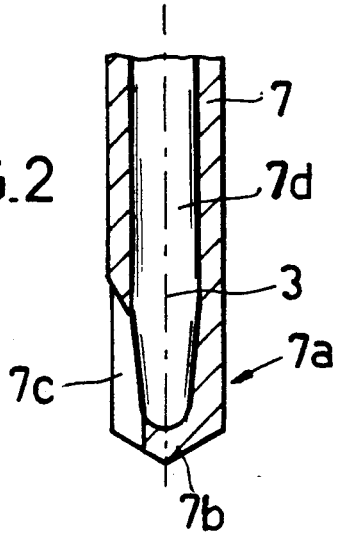
FIG. 2 is a large-scale view of the lower end of the dip tube of the reservoir.
Figure 3:
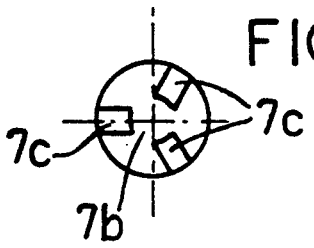
FIG. 3 is a bottom view of the structure of FIG. 2.

According to this invention a dip tube 7 unitary with the wall 2*b* extends downward along the axis 3 from the outlet 4 and has an overall length 1 equal to about half the length L so that the device will work equally well upside down. This tube 7 has a lower end 7*a* formed as best seen in FIG. 2 with a crosswise web 7*b* blocking it and is formed with three axially elongated slots 7*c* angularly equispaced about the axis 3 and extending axially therealong. These slots 7*c* have a width equal to substantially less than the inside diameter of the tube 7 and in fact set in accordance with the composition of the combustible liquid so that a liquid/vapor interface meniscus is formed at them. In other words these slots *7c* are so thin that the combustible forms a meniscus at them and vaporizes at the surface of the meniscus if the overlying vapor pressure permits this.

The tube 7 has an upper end *7e* just below the outlet 4 that is provided with a flow-controlling filter 8 that permits the gaseous phase of the combustible to pass but that is of such small pore size that it would be blocked by the liquid phase of the combustible.

The combustible gas used has the following composition by weight:

| | |
|---|---|
| isobutane | 50%; |
| N-butane | 35% (with traces of ethane and methane; and |
| propane | 15%. |

The slots *7c* are 0.5 mm wide and 3.0 mm long.

We claim:

1. A reservoir for a gaseous combustible stored as a liquid, the reservoir comprising:

a substantially closed container having a side wall, an upper wall, and a bottom wall, the upper wall being formed with an outlet port;

a porous mass generally filling the container;

a body of the combustible in liquid condition generally saturating the mass; and a dip tube having an upper end joined to the upper wall at the outlet and a lower end formed with at least one orifice of such small size that a meniscus-/interface is formed between the liquid and gaseous phases at the orifice.

2. The reservoir defined in claim 1 wherein the tube is formed with a crosswise web at its lower end and the orifice is above this web on a side of the tube.

3. The reservoir defined in claim 1 wherein the orifice is an elongated throughgoing slot.

4. The reservoir defined in claim 1 wherein the container is generally cylindrical and centered on an axis, the outlet port and tube being coaxial with the container.

5. The reservoir defined in claim 4 wherein the tube is formed with a plurality of such orifices angularly equispaced about the axis.

6. The reservoir defined in claim 5 wherein there are three such orifices.

7. The reservoir defined in claim 1 wherein the tube has an upper end provided with an outflow controller.

8. The reservoir defined in claim 1 wherein the tube is unitarily formed with the upper wall.

9. The reservoir defined in claim 1 wherein the container has a predetermined height and the tube has a predetermined vertical length equal generally to half of the height.

* * * * *